United States Patent [19]

Ady

[11] 4,097,407

[45] Jun. 27, 1978

[54] CLEANING COMPOSITION DERIVED FROM POTATO PROCESSING WASTES

[75] Inventor: Esthmel W. Ady, Richland, Wash.

[73] Assignee: Larry Dale Ady, Kennewick, Wash.

[21] Appl. No.: 565,241

[22] Filed: Apr. 4, 1975

[51] Int. Cl.[2] ..... C11D 13/00; C11D 9/38

[52] U.S. Cl. ..... 252/370; 210/65; 252/132; 252/368

[58] Field of Search ..... 252/89, 132, 131, 368, 252/369, 376; 127/32, 66, 67; 210/65

[56] References Cited

U.S. PATENT DOCUMENTS

| | | | |
|---|---|---|---|
| 580,583 | 4/1897 | Richards | 252/131 |
| 758,944 | 5/1904 | Tyler | 106/5 |
| 1,432,440 | 10/1922 | Burmeister | 106/5 |
| 1,961,031 | 5/1934 | Beris | 106/4 |
| 2,193,329 | 3/1940 | Curzon | 252/132 |
| 2,300,413 | 11/1942 | Gaver | 252/132 |
| 2,870,029 | 1/1959 | Soboleski | 106/5 |
| 2,982,735 | 5/1961 | Blinka et al. | 252/132 |
| 3,629,121 | 12/1971 | Eldib | 252/79 |
| 3,652,301 | 3/1972 | Damron | 106/5 |
| 3,803,285 | 4/1974 | Jensen | 252/89 |

FOREIGN PATENT DOCUMENTS

| | | | |
|---|---|---|---|
| 2,230 of | 1859 | United Kingdom | 252/132 |

OTHER PUBLICATIONS

Martin–The Modern Soap & Det. Ind., vol. II (1951), The Techn. Press pp. 33–34.

Rose Cond. Chem. Dict. vol. 7, Reinhold Publ. Co. p. 25.

*Primary Examiner*—Harris A. Pitlick

*Attorney, Agent, or Firm*—Clarence A. O'Brien; Harvey B. Jacobson

[57] ABSTRACT

A process for the preparation of a cleaning composition from potato processing wastes comprises forming a digest of potato wastes in caustic alkali, reacting animal or vegetable oil, preferably potato processing waste oil, with caustic alkali to form a liquid soap and cooking an 80:20 - 40:60 blend of liquid soap to potato digest at 180 - 212° F. for from 30 - 60 minutes to form a cleaning composition concentrate. The concentrate is preferably filtered to remove fibrous material and other solids after which it may be modified with conventional additives and diluted, the additives and degree of dilution depending upon the ultimate intended usage and preferred physical form of the composition.

14 Claims, 1 Drawing Figure

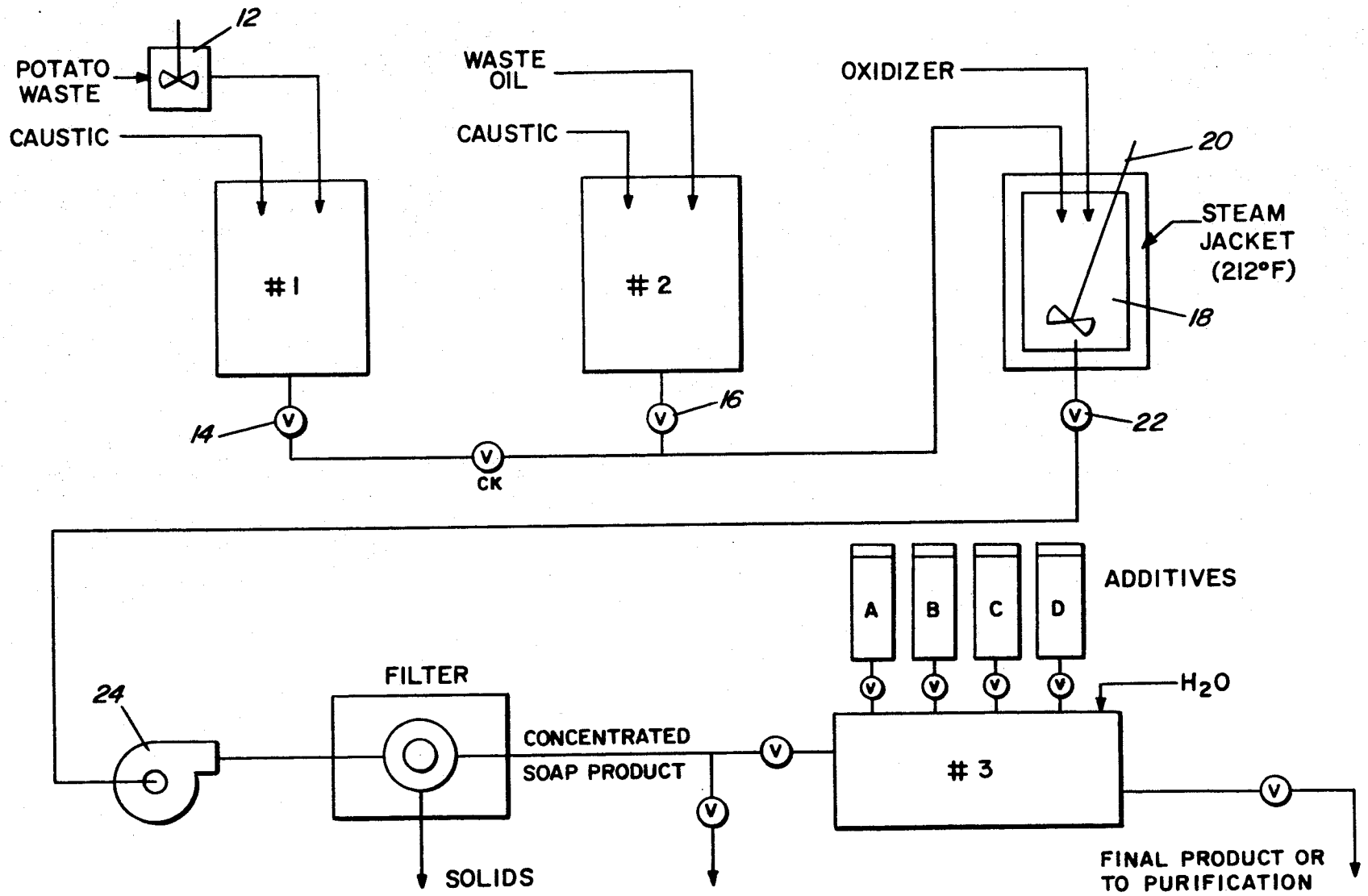
STEAM JACKET (212°F)
20
18
22
OXIDIZER
ADDITIVES
$H_2O$
FINAL PRODUCT OR TO PURIFICATION
D
C
B
A
#3
#2
16
WASTE OIL
CAUSTIC
CK
CONCENTRATED SOAP PRODUCT
FILTER
SOLIDS
#1
12
14
24
POTATO WASTE
CAUSTIC

CLEANING COMPOSITION DERIVED FROM POTATO PROCESSING WASTES

The present invention relates to organic cleaning compositions and, more particularly, to cleaning compositions prepared from vegetable starches.

There is a need today for cleaning compositions which can be inexpensively prepared in a simple manner from readily available materials. Moreover, present day cleaning compositions must be environmentally safe, i.e., they should be readily biodegradable and, at the same time, possess a low nutrient level.

It is therefore an object of the present invention to provide a multi-use cleaning composition made from readily available vegetable starch.

It is another object of the invention to provide a cleaning composition readily made from vegetable starch waste matter, particularly potato production waste.

It is still another object of the invention to provide a cleaning composition, and a method of producing same, which composition is readily biodegradable and low in nutrients.

Other objects and advantages will become apparent from the following description and appended claims taken in conjunction with the accompanying Figure which is a schematic representation of a preferred form of the process of the present invention.

Briefly stated, in accordance with the aforesaid objects, the cleaning composition of the present invention is prepared by heating an aqueous mixture of potato processing wastes, including starch, oils and caustic alkali, at elevated temperatures and thereafter adding to the cooked mixture chemical modifiers and diluents in appropriately small quantities to formulate the desired final cleaning product in the desired physical form, e.g., liquid granular, bar soap, flake or other physical form of cleaning compound for specific and/or specialized purposes.

The primary composition forming ingredient is the vegetable starch which is desirably obtained from a low-protein starch source such as corn, wheat, rice or tapioca. Tubers of all types are preferred, such as potato peelings, culls, whole Irish potatoes, and the like. At present, potato processing plants separate, e.g., by screening, settling, vacuum filtration and skimming, the processing wastes and dispose of them as animal feed, as grease for rendering plants, as soil enhancers, and the like. Of course, waste quantities and methods of disposition vary from plant to plant depending upon the degree of recycling practiced within the plant, the particular production process practiced at the plant, plant location, land availability, proximity of animal farms, etc. Nevertheless, it has been found that the use of potato plant wastes, either as the totality of raw starting materials or as some significantly large fraction thereof, to prepare a cleaning composition concentrate has very favorable economics. This is particularly so since the vegetable starch source may take any physical form. For example, potatoes, in addition to the forms set forth above may be cut, peeled, shredded or mashed. If the vegetable starch source has an insoluble skin or hull, the insoluble material can be readily removed by filtration during processing. For the purpose of this application, the term "starch containing potato processing wastes" is defined as the vegetable starch waste material from potato processing plants which contains appreciable quantities of potato starch.

The raw starting materials for the present process are all readily available as the prevalent constituents of potato processing plant wastes. An exemplary breakdown of wastes produced at a typical lye peeling, fried potato product plant is set forth below:

Waste Materials from a Potato Processing Plant

1. Reject Potatoes and other Potato Starch Waste:
Approx. 0.5 ton Waste/1.0 ton of Raw Potatoes processed
2. Potato Waste Breakdown
Approx. 30% — Peewees (small potatoes)
60% — Solids from Screening and Vacuum Filtration
10% — Lost in Primary Effluent
3. Caustic Waste:
Approx. 5 lbs. (as NaOH)/1.0 ton of Finished Potato Product
4. Oil and Grease Waste:
Approx. 35 lbs./1.0 ton of Finished Potato Product
5. Water Use:
Approx. 1400–3000 gallons/1.0 ton of Raw Potatoes Processed Only two alkalies are believed to be economically practical for use in preparing the cleaning compositions of the present invention. Sodium hydroxide is the preferred alkali because it is least expensive and most readily available. Potassium hydroxide is also suitable but is somewhat more expensive and not as readily available. However, potassium hydroxide is particularly advantageous if the end product is to be a liquid soap since potassium soaps are fully soluble in water to give liquid soap solutions containing up to 25% solids. Some sodium soaps on the other hand, especially the stearates, form gels in water solution. Ammonium hydroxide and calcium hydroxide, for example, are not suitable for use because the former is not a strong enough alkali while the latter forms an insoluble precipitate with fatty acids. The amount of alkali employed depends upon a number of factors —primarily upon the amount of starch material present, but also upon the starch form and its water content. Generally, however, sufficient alkali should be used to give the final concentrated product a pH of 10 - 11. This pH objective can usually be obtained with a weight ratio of caustic to starch of about 1:6.

Nearly any fatty acid source, such as animal fats or vegetable oils, can be used in the present process to form the instant cleaning composition although the waste oils from potato processing are preferred from the standpoint of economics. While fats such as tallow and coconut oil are generally preferred in the industry, according to the present invention which employs an unusually large proportion of starch compared to conventional processes, the choice of fat is less important for control of cleaning composition properties. Exemplary suitable animal fats include pure lard (pork) and beef fats (suet). Among the useful vegetable oils are peanut oil, olive oil, corn oil, soybean oil, and the like.

To prepare the cleaning compositions of the present invention the vegetable starch, such as potato or potato waste is pulped, ground, crushed or otherwise pulverized or particulated, and caustic alkali is added thereto to form a liquid potato digest. Inasmuch as the quantity of alkali employed is dependent upon a number of variables, it is recommended that preliminary tests be conducted to ascertain the requisite alkali quantity to provide a pH 10 - 11 concentrated product with the particular vegetable starch source material selected. In addition to pulverizing and/or particulating the vegetable starch, the pulping or grinding operation also renders the starch, thereby assisting its solutioning with the alkali. The resulting potato digest or liquefied starch is admixed in suitable proportions, depending upon the desired properties of the finished product, with a liquid soap solution which is prepared by reacting the vegetable or animal oil, preheated to 135° - 150° F., preferably about 140° F., with a thin stream of caustic. The potato digest-liquid soap admixture is then uniformly cooked in suitable apparatus, such as a steam jacketed cooker, at atmospheric pressure in an air environment at temperatures up to about 212° F., preferably 180° - 212° F. Exemplary of the apparatus that can be used in the present process is the apparatus disclosed in copending application Ser. No. 316,686, filed Dec. 20, 1972 for Food Preparation and Dispensing System, now U.S. Pat. No. 3,945,534. The precise temperature selected for the cooking is itself unimportant, it being dependent in large part upon the selected cooking time. However, an exemplary time-temperature combination found generally satisfactory for cooking the admixture is about 212° F. for from 30 minutes to one hour. During the cooking, air is preferably blown through the cooker to cause agitation and, at the same time, to cause some degradation of the starch by oxidation. Simultaneous mechanical agitation of the admixture is also desirable.

The properties of the resulting concentrated potato soap product depend, in part, upon the proportions in which the potato digest solution and the liquid soap solution have been blended. It has been found that a satisfactory product can be formed by blending the liquid soap to potato digest (liquid starch) in a weight ratio of from 80:20 to 40:60 on a dry solids basis. At low soap properties, the cleaning composition concentrate is pasty. However, as the proportion of liquid soap increases, the tendency of the composition to form a firm gel also increases. On the other hand, the foaming properties of the composition appear to improve with increased proportions of liquid potato digest. Best results in terms of the physical consistency and foaming properties of the concentrated cleaning product appear to be attained at a liquid soap to liquid potato digest weight ratio of about 60:40 on a dry solids basis.

Although the cleaning composition concentrate has been formed at the completion of the cooking step, it is desirable at that point in the process to remove any undigested potato materials, such as excess fibrous material, skin residue, lignocellulose and excess starch granules, by filtration or equivalent removal technique. It has been found, however, as a practical matter, that it is undesirable and unnecessary to attempt to remove all undigested potato materials since the materials tend to pack during filtration to form a poorly permeable filter cake causing subsequent filtration to be uneconomically slow. It is therefore recommended that only limited filtration be attempted. In this connection filtration through a centrifugal extracting sieve, such as a 28-mesh self-cleaning screen, has been found to be satisfactory in terms of balancing production economies with the desirability of removing excess solids. The filtered material has some value as animal feed and can often be profitably disposed of in that fashion. The filtrate is the concentrated cleaning composition of the present invention, substantially free of undesirable excess solids, which can either be used as is or, more desirably, can be modified by the addition of appropriate chemicals and diluents to form commercially practical products. Exemplary of chemical additives are the well known coloring or scenting additives, foaming agents, brighteners, and the like. For most purposes the concentrated composition is preferably diluted with water, for example in ratios of from 1:8 to 1:10 concentrate to water, depending upon the intended ultimate use. Such dilution generally reduces the pH of the composition to the range 9 - 10 and, in such aqueous form, the composition is useful, for example, as a laundry detergent, surface cleaner (e.g., sinks, walls, counters, painted and metallic surfaces), dishwashing detergent, hand soap, floor cleaner, shampoo, or in most any other application where soap is generally useful.

The accompanying FIGURE of the Drawing depicts a typical process for the production of the cleaning compositions of the present invention from potato processing wastes.

Referring to the FIGURE, it can be seen that potato wastes, such as culls and scraps, are initially particulated or pulverized in pulper 12 to reduce the particle size and thereby to enhance the liquefication of the starch component. The particulated potato wastes together with the preferred sodium hydroxide or potassium hydroxide caustic are admixed in Tank #1 at ambient temperature to form a potato digest. The relative proportions of potato waste to caustic should be in the range of 9 to 11 parts by weight dry caustic to each 100 parts dry potato solids, the precise quantity of caustic in each case depending upon factors such as moisture content of the wastes, ultimate intended product and the like. Water is added as necessary to assure a water content in Tank #1 of from 40 to 60 parts water per 100 parts potato solids. One exemplary admixture in Tank #1 includes 10 parts dry sodium hydroxide to 100 parts potato solids and contains 40 parts water.

In Tank #2, waste potato oils from potato processing are preheated to the range 135° to 150° F., preferably 140° F., and are contacted and reacted with a thin stream of caustic. The relative quantities of oil and caustic should be in the range 9 to 11 parts dry caustic per 100 parts by weight oil. Water is also present in Tank #2 in amounts ranging from 25 to 28 parts by weight water per 100 parts by weight oil. The oil and caustic react to raise the temperature in Tank #2 to the range about 190° - 212° F. and to form a liquid soap solution.

The potato digest from Tank #1 and the liquid soap from Tank #2 are metered, respectively, through valves 14, 16 in appropriate quantities as hereinbefore set forth, and directed to a cooking chamber 18 where the mixture can be heated to 180° - 212° F. for about 30 - 60 minutes to form the concentrated potato soap composition of the present invention. Air or equivalent oxidizer is bubbled through the mixture to provide agitation and to assist in the degradation of the starch. Mechanical agitation (such as furnished by agitator 20) may also be provided. Preferably, the chamber is a steam-jacketed cooker such as is disclosed in aforementioned U.S. Ser. No. 316,686, filed Dec. 20, 1972.

The potato soap concentrate is pumped from chamber 18 through outlet control valve 22 via pump 24 into a self-cleaning screen filter unit to remove potato skin residues, fibrous matter, undigested starch and other potato solids which may be present. The soap concentrate of the present invention (filtrate) is fed to Tank #3 wherein any number of conventional additives, e.g., A, B, C, D, may be admixed with the concentrate and, at the same time, the concentrate can be diluted to final product form. Of course, in accordance with known practice, the extent of dilution and the identity and quantity of the additives employed depend upon the desired physical form and intended usage of the end product. The end product is permitted to cool the ambient temperature, usually in a large tank, for at least 24 hours to permit it to set-up.

EXAMPLE I

Using the process of the present invention, potato culls and scraps having a moisture content of about 92% water were admixed with dry sodium hydroxide in a ratio of 10 parts of dry sodium hydroxide per 100 parts of dry potato solids. An additional quantity of 40 parts of water per 100 parts of dry potato solids was also added and the aqueous potato-caustic solution was admixed to form a potato digest. In a separate tank, waste potato processing oils were heated to 140° F. and reacted with 10 parts of dry sodium hydroxide per 100 parts of oil to form a liquid soap. The liquid soap and potato digest were respectively metered into a steam-jacketed cooking chamber in the weight ratio of 60:40 soap to digest on a dry solids basis. Air was passed through the chamber and the soap-digest was mechanically agitated while being heated for 30 minutes to about 212° with 212° F. steam passing through the chamber jacket at atmospheric pressure. The resulting product was screened through a centrifugal extracting 28 mesh sieve and the filtrate was diluted with 8 parts water per part filtrate. The resulting product which was about 94.8% liquid and 5.2% solids, was stored in a large tank and permitted to cool for about 24 hours during which time it hardened to set-up.

EXAMPLE II

The potato soap composition filtrate from Example I was analyzed to include volatiles by oven drying at 105° C, ash at 550° C, alkalinity by titration with standardized HCl, pH by a Beckman pH meter, surface tensions by du Nuoy tensionmeter, fatty acids by extraction of the acidified product, undissolved solids by centrifugation of aqueous dilution of the product, solidifying points by thermometer, and trace elements by emission spectrograph. Sodium was calculated from the ash analysis, glycerol was calculated from the fatty acids and the total starch plus other trace components were calculated by difference. The results are given in Table I.

Table I

| Analysis | Composition | |
|---|---|---|
| | As Received | Dried |
| Volatiles (water) | 84.5 | — |
| Nonvolatiles, fatty acids | 8.9 | 58 |
| sodium ion | 2.2 | 14 |
| glycerol | 1.0 | 6 |
| starch, etc. | 3.4 | 22 |
| Total | 100.0 | 100 |
| Ash | 5.0% | |
| Undissolved solids (approximate) | 2.6% | |
| Alkalinity | 740 meq $g^{-1}$ | |
| pH | 12.0 | |
| Solidifying point | 49° C (first gel)<br>42° C (solid) | |
| Surface tension (1% solution) | 29.8 dynes $cm^{-1}$ | |
| (0.1% " ) | 30.0 " | |
| (0.01% " ) | 46.1 " | |

| Ash Analysis (qual spectrographic) | Element | Approximate Amount |
|---|---|---|
| | sodium | Major component |
| | silicon | 1% |
| | lead | .1% |
| | aluminum | " |
| | calcium | " |

Table I-continued

| Analysis | | |
|---|---|---|
| | magnesium | " |
| | zinc | .01% |
| | silver | " |
| | strontium | " |
| | Phosphorus | trace |
| | iron | " |
| | copper | " |
| | potassium | " |

The filtrate composition dispersed in hot water easily and gelled upon cooling. The undiluted product (15% solids) on cooling started to gel at 49° C and became solid at 42° C. A dilute solution upon cooling formed a stiff gel down to 0.67% solids and a liquid with some gel strands down to 0.09% solids.

For some purposes, the potato soap product thus far described is of insufficient purity and further refining is desirable. The refining may take place at the same location at which the potato soap was prepared or at a remote location. To refine the potato soap, it should be heated in a tank to about 150° F. to liquefy the soap and an alkali, such as sodium or potassium hydroxide, added to the heated soap in quantities of from ½ to 1 pound of dry alkali per each 10 pounds of potato soap, preferably in a ratio of alkali to potato soap of 1 to 10. The precise quantity of alkali added will depend upon the degree of hardness desired in the final soap product. Approximately 25% by volume of water is then added to the alkali-soap mixture (although there is nothing critical about the extent of water dilution for purification purposes, 25% by volume appears to be an advantageous quantity from the standpoint of the relative strength of the final liquid cleaner product) and the resulting aqueous mixture maintained at a 212° F. rolling boil for about 12 to 15 minutes. If desired, air can be metered into the mixture to eliminate boiling over.

The refining process converts the potato soap to a high purity, very fine grade solid soap which floats to the surface of the aqueous mixture. The remaining liquid constitutes an excellent low sudsing commercial liquid cleaner which will not gel upon cooling, i.e., it will remain a liquid. The liquid cleaner may be readily separated from the high purity soap by draining the liquid through a drain tap located near the base of the tank.

While the present invention has been described with reference to particular embodiments thereof, it will be understood that numerous modifications can be made by those skilled in the art without actually departing from the scope of the invention. Accordingly, all modifications and equivalents may be resorted to which fall within the scope of the invention as claimed.

What is claimed as new is as follows:

1. A process for preparing a soap concentrate from potato processing wastes comprising the steps of:

(a) mixing pulverized starch-containing potato processing wastes with an alkali selected from the group consisting of sodium and potassium hydroxide in the presence of water to form a liquid potato digest;

(b) reacting a fatty acid source selected from the group consisting of animal fats and vegetable oils with an alkali selected from the group consisting of sodium and potassium hydroxide at a temperature in the range 135° - 150° F. to form a liquid soap;

(c) admixing said liquid soap and potato digest in a weight ratio of from 80:20 to 40:60 on a dry solids basis;

(d) heating said admixture in the presence of oxygen at a temperature in the range 180° - 212° F. for from 30 to 60 minutes to form a concentrated biodegradable cleaning composition;

(e) additionally heating the concentrated cleaning composition to about 150° F.;

(f) adding from one-half to one pound of dry caustic selected from the group consisting of sodium and potassium hydroxide for each ten pounds of concentrated cleaning composition;

(g) diluting the mixture resulting in (f) with water;

(h) boiling the resulting aqueous mixture; and, (i) permitting the boiled mixture to cool and to separate into a solid soap portion and a liquid cleaner portion.

2. A process as claimed in claim 1, wherein said concentrated cleaning composition in step (d) exhibits a pH in the range 10 to 11.

3. A process, as claimed in claim 1, wherein said concentrated cleaning composition in step (d) is diluted with water in the ratio of from 1:8 to 1:10 of said composition to water.

4. A process, as claimed in claim 3, wherein said diluted composition exhibits a pH in the range 9 to 10.

5. A process, as claimed in claim 1, wherein said liquid soap and potato digest in step (c) are admixed in a weight ratio of 60:40.

6. A process, as claimed in claim 1, when in step (a) 9 to 11 parts by weight dry caustic is mixed with each 100 parts by weight dry potato solids in the potato processing wastes in the presence of 40 to 60 parts by weight water per 100 parts by weight dry potato solids.

7. A process, as claimed in claim 1, wherein where in step (b) said fatty acid source is heated to 135° - 150° F. prior to reaction with said alkali.

8. A process, as claimed in claim 7, wherein 9 to 11 parts by weight dry caustic is reacted with each 100 parts by weight fatty acid source in the presence of 25 to 28 parts by weight water per 100 parts by weight fatty acid source.

9. A process, as claimed in claim 1, wherein said fatty acid source in step (b) is potato processing waste oils.

10. A process, as claimed in claim 1, wherein said heating in step (d) is accomplished at 212° F. for about 30 minutes and an oxygen containing gas is bubbled therethrough.

11. A process, as claimed in claim 1, wherein said admixture in step (d) is mechanically agitated during heating.

12. A process, as claimed in claim 1, including the further step of removing solid residue from said concentrated cleaning composition following heating.

13. A process, as claimed in claim 12, wherein said solid residue removal is accomplished by filtration.

14. A process, as claimed in claim 1, wherein one pound of said alkali is added for each 10 pounds of concentrated cleaning composition; said mixture is diluted with about 25% of its own volume of water; and said aqueous mixture is boiled for about 12 to 15 minutes.

* * * * *